US010836563B2

(12) United States Patent
Moon et al.

(10) Patent No.: US 10,836,563 B2
(45) Date of Patent: Nov. 17, 2020

(54) METHOD OF PACKAGING BED LINENS

(71) Applicant: Purple Innovation, LLC, Alpine, UT (US)

(72) Inventors: Shawn David Moon, Cedar Hills, UT (US); Jennifer Jo Goodwin, Salt Lake City, UT (US)

(73) Assignee: Purple Innovation, LLC, Lehi, UT (US)

( * ) Notice: Subject to any disclaimer, the term of this patent is extended or adjusted under 35 U.S.C. 154(b) by 305 days.

(21) Appl. No.: 15/902,737

(22) Filed: Feb. 22, 2018

(65) Prior Publication Data

US 2018/0178971 A1 Jun. 28, 2018

Related U.S. Application Data

(62) Division of application No. 15/334,093, filed on Oct. 25, 2016, now Pat. No. 10,202,234.

(51) Int. Cl.
*B65D 85/07* (2017.01)
*B65D 43/16* (2006.01)
(Continued)

(52) U.S. Cl.
CPC ..... *B65D 85/07* (2018.01); *B65D 5/4204* (2013.01); *B65D 5/66* (2013.01); *B65D 43/16* (2013.01);
(Continued)

(58) Field of Classification Search
CPC ..... B65D 5/2052; B65D 5/4204; B65D 5/66; B65D 5/6611; B65D 5/6626;
(Continued)

(56) References Cited

U.S. PATENT DOCUMENTS 1,202,648 A * 10/1916 Barta ..... B65D 5/6632 229/143
1,682,449 A * 8/1928 Vest ..... B65D 5/4204 206/772
(Continued)

FOREIGN PATENT DOCUMENTS

CN 205602280 U 9/2016
DE 7635125 U1 4/1977
(Continued)

OTHER PUBLICATIONS

International Search Report for PCT Application No. PCT/US2017/057210, dated Dec. 22, 2017, 3 pages.
(Continued)

*Primary Examiner* — Stephen F. Gerrity
(74) *Attorney, Agent, or Firm* — Durham Jones & Pinegar, P.C.

(57) ABSTRACT

A method of forming a packaging box and disposing at least one bed linen in the packaging box. Forming the packaging box to have a back panel, four side panels, a first front panel, and a second front panel attached to one of the side panels. Configuring the first front panel to have an aperture and to be an interior panel enclosed within the packaging box when the packaging box is in a closed configuration. Configuring the second front panel to fold relative to a side panel such that it is an exterior front panel in the closed configuration. Configuring the exterior front panel to include an exterior side panel and configuring the exterior side panel to lay adjacent a side panel in the closed configuration. Configuring the exterior side panel to include an attachment device securing the exterior side panel to the adjacent side panel in the closed configuration.

16 Claims, 3 Drawing Sheets

(51) Int. Cl.
*B65D 43/22* (2006.01)
*B65D 5/66* (2006.01)
*B65D 5/42* (2006.01)

(52) U.S. Cl.
CPC ..... *B65D 43/22* (2013.01); *B65D 2201/00* (2013.01); *B65D 2313/02* (2013.01); *B65D 2313/04* (2013.01)

(58) Field of Classification Search
CPC .... B65D 5/6647; B65D 5/6673; B65D 43/16; B65D 43/22; B65D 85/07; G09F 5/00
USPC ..... 53/377.5; 206/494; 220/230, 259.2, 826, 220/833; 229/124, 131.1, 142
See application file for complete search history.

(56) References Cited

U.S. PATENT DOCUMENTS 1,780,135 A * 10/1930 Lee ..... B65D 5/4204 229/87.15
1,824,927 A * 9/1931 Powell ..... B65D 5/6655 229/150
2,256,074 A 9/1941 Crebbs
2,285,991 A * 6/1942 Lester ..... B65D 5/4204 206/773
2,445,001 A * 7/1948 Pence ..... B65D 5/72 206/268
2,874,707 A 2/1959 Koppel
3,087,605 A 4/1963 Kester
3,405,836 A * 10/1968 Regis, Jr. ..... B65D 43/162 220/522
3,749,301 A * 7/1973 Peckar ..... B65D 5/6673 229/125.37
3,937,393 A * 2/1976 Nerenberg ..... B65D 5/66 229/131.1
4,284,193 A * 8/1981 Roccaforte ..... B65D 5/4204 206/773
D313,140 S 12/1990 Johnson
5,145,091 A * 9/1992 Meyers ..... B65D 75/5838 206/494
D334,502 S 4/1993 Hill
D338,796 S 8/1993 Staudinger
5,458,235 A * 10/1995 Stone ..... B65D 5/4204 206/232
6,070,719 A * 6/2000 Pollock ..... B65D 5/4204 206/232
6,371,366 B1 * 4/2002 Edgerton et al. .... B65D 5/4204 206/756
D467,117 S 12/2002 Guy
D507,919 S 8/2005 Bishop
D600,549 S 9/2009 Anderson et al.
D602,353 S 10/2009 Anderson et al.
7,673,787 B2 * 3/2010 Mittelstaedt ..... B65D 5/665 229/117.16
D617,637 S 6/2010 Anderson et al.
D651,891 S 1/2012 Bell
8,601,728 B2 * 12/2013 Philipps ..... B65D 5/66 206/776
8,720,718 B2 5/2014 Myers et al.
D774,801 S 12/2016 Clark et al.
D792,124 S 7/2017 Blatt et al.
9,868,577 B2 1/2018 Ridgeway
2004/0055257 A1 3/2004 Parrotta et al.
2005/0121347 A1 * 6/2005 Hanson ..... G09F 5/00 206/440
2007/0151887 A1 * 7/2007 Clark, Jr. et al. ..... B65D 77/04 206/494
2008/0164734 A1 7/2008 Nile et al.
2008/0264983 A1 10/2008 Kastan
2010/0006632 A1 * 1/2010 Conroy ..... B65D 5/4204 229/120.18
2010/0018888 A1 1/2010 Hamilton
2010/0213094 A1 8/2010 McKay
2011/0192891 A1 8/2011 Farris
2011/0204129 A1 8/2011 Conroy
2011/0315584 A1 12/2011 Hofgartner
2013/0112741 A1 * 5/2013 Jo ..... B65D 5/4204 229/126
2013/0193011 A1 8/2013 Scanlan et al.
2014/0102920 A1 4/2014 Kim

FOREIGN PATENT DOCUMENTS

DE 202011003672 U1 * 9/2011 ..... B65D 5/6611
DE 202015106695 U1 * 12/2015 ..... B65D 5/4204
EP 1792832 A1 * 6/2007 ..... B65D 5/4204
ES 1032926 Y 12/1996
FR 1011377 A * 6/1952 ..... B65D 5/4204
FR 2288044 A1 * 5/1976 ..... B65D 5/4204
PT 9 036 U 11/1994
TW 476342 U 2/2002

OTHER PUBLICATIONS

Written Opinion of the International Searching Authority for PCT Application No. PCT/US2017/057210, dated Dec. 22, 2017, 9 pages.
Saferest, Premium Mattress Protector, http://www.saferest.com/premium-mattress-protectors.html, Oct. 25, 2016, 2 pages.
Wamsutta, Dream Zone, Sheet Set, http://www.ebay.com/itm/Wamsutta-Dream-Zone-queen-size-sheet-set-/252599924659?hash=item3ad020f7b3:g:FD0AAOSwImRYDCPc, Oct. 25, 2016, 1 page.
Taiwanese Office Action and Search Report from Taiwanese Application No. 106136732 dated Jun. 8, 2018, 21 pages with English translation.
Introducing Purple Sheets, video dated Dec. 1, 2016, time stamp: 3:36, [online], [site visited Feb. 19, 2018]. Available from Internet, URL: https://www.youtube.com/watch?v=Oec0Xtq06AO (Year: 2016).
European Patent Office, "Extended European Search Report," European Patent Application No. 17864930.7, dated Apr. 9, 2020.
China National Intellectual Property Adminstration, First Office Action, Chinese Patent Application No. 201780065952.3, dated Mar. 24, 2020.
Canadian Intellectual Property Office, "Examiner's Report," Canadian Application No. 3037390, dated Jul. 21, 2020.

* cited by examiner

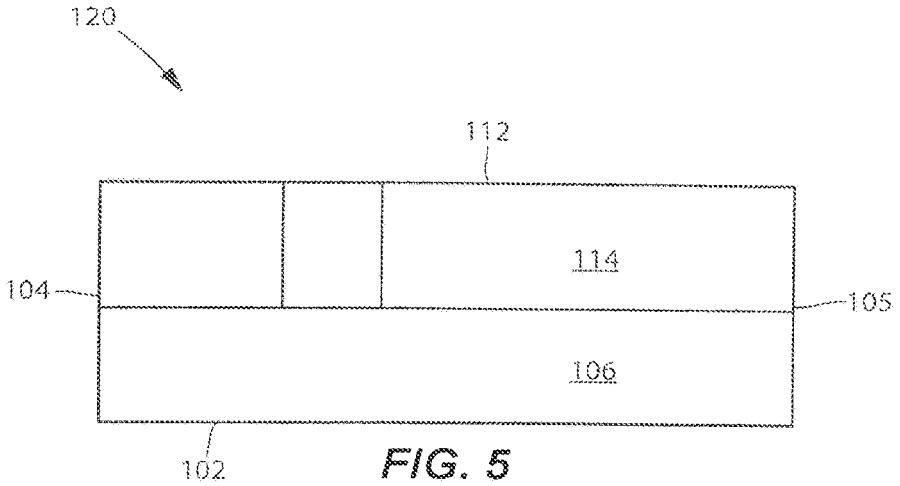
FIG. 5
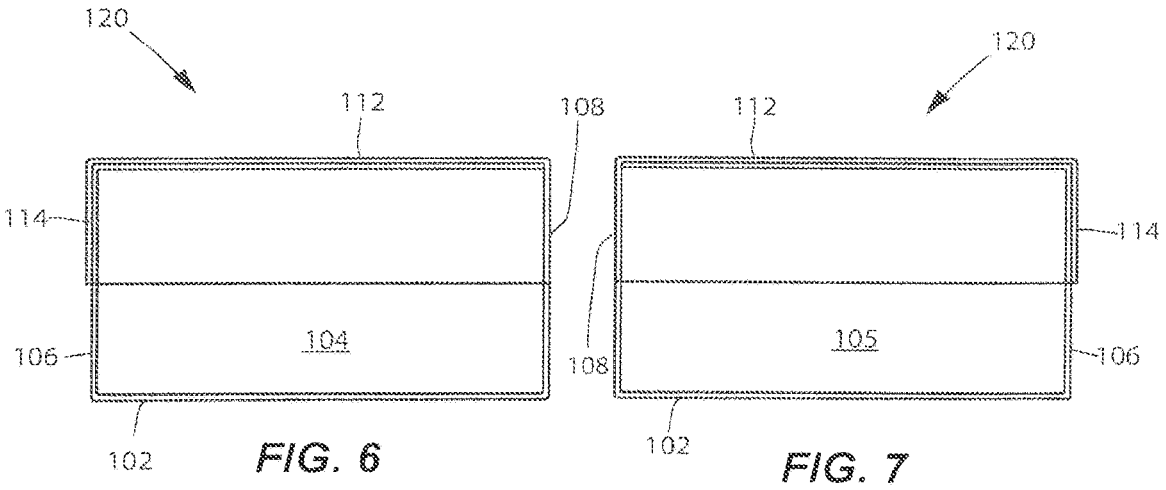
FIG. 6
FIG. 7

METHOD OF PACKAGING BED LINENS

CROSS-REFERENCE TO RELATED APPLICATION

This application is a divisional of U.S. patent application Ser. No. 15/334,093, filed Oct. 25, 2016, the disclosure of which is hereby incorporated herein in its entirety by this reference.

FIELD

Embodiments of the disclosure relate generally to packaging for bed linens, such as fitted sheets, flat sheets, pillow cases, and mattress protectors.

BACKGROUND

Packaging for bed linens, including bed sheets and mattress protectors, commonly consists of a vinyl or vinyl and canvas case that is transparent so as to allow a potential purchaser to view the linens within the packaging. An insert is often included within the package that contains the branding, marketing, and product information thereon.

It is also known to package bed linens in a bag made of the same material constituting the bed linens. Some bed linens have been sold without any packaging other than a band that is wrapped around the folded linen, which includes the branding, marketing, and product information thereon. Bed linens have also been packaged in a standard rectangular cardboard box.

BRIEF SUMMARY

In some embodiments, the present disclosure includes a packaged bed linen. The packaged bed linen comprises at least one bed linen disposed in a packaging box. The packaging box includes a back panel, a top side panel, a bottom side panel, a first lateral side panel, a second lateral side panel, a first front panel, and a second front panel attached at an edge thereof to an edge of one of the first and second lateral side panels and configured to fold relative thereto.

The first front panel may be sized and configured so as to be an interior front panel enclosed within the packaging box when the packaging box is in a closed configuration. The second front panel may be sized and configured so as to be an exterior front panel exposed on the exterior of the packaging box when the packaging box is in the closed configuration. The exterior front panel may further include an exterior side panel configured to lay adjacent one of the first and second lateral side panels when the packaging box is in the closed configuration. The exterior side panel may include at least one attachment device securing the exterior side panel to the adjacent one of the first and second lateral side panels when the packaging box is in the closed configuration.

In additional embodiments, the present disclosure includes methods for packaging a bed linen. In accordance with such a method, a packaging box may be formed that includes a back panel, a top side panel, a bottom side panel, a first lateral side panel, a second lateral side panel, a first front panel, and a second front panel attached at an edge thereof to an edge of one of the first and second lateral side panels and configured to fold relative thereto. The first front panel may be sized and configured so as to be an interior front panel enclosed within the packaging box when the packaging box is in a closed configuration. The second front panel may be sized and configured so as to be an exterior front panel exposed on the exterior of the packaging box when the packaging box is in the closed configuration. The exterior front panel may further include an exterior side panel configured to lay adjacent one of the first and second lateral side panels when the packaging box is in the closed configuration. The exterior side panel includes at least one attachment device securing the exterior side panel to the adjacent one of the first and second lateral side panels when the packaging box is in the closed configuration.

After forming the packaging box, at least one bed linen may be disposed in a space defined by the back panel, the top side panel, the bottom side panel, the first lateral side panel, and the second lateral side panel of the packaging box. The interior front panel then may be positioned so as to at least partially cover the at least one bed linen within the packaging box. The exterior front panel may be folded relative to the one of the first and second lateral side panels to which it is attached, such that the exterior front panel is disposed adjacent the interior front panel, and the exterior side panel may be folded relative to the exterior front panel, and the exterior side panel may be secured to an adjacent one of the first and second lateral side panels.

BRIEF DESCRIPTION OF THE DRAWINGS

While the specification concludes with claims particularly pointing out and distinctly claiming what are regarded as embodiments of the present invention, various features and advantages of embodiments of the disclosure may be more readily ascertained from the following description of example embodiments when read in conjunction with the accompanying drawings, in which:

FIG. 5 is a left side view of the packaged bed linen of FIGS. 3 and 4;

FIG. 6 is a top side view of the packaged bed linen of FIGS. 3-5; and FIG. 7 is a bottom side view of the packaged bed linen of FIGS. 3-6.

DETAILED DESCRIPTION

The illustrations presented herein are not actual views of any particular package, or packaged bed linen, but are merely idealized representations employed to describe embodiments of the present disclosure. Elements common between figures may retain the same numerical designation.

Figure 1:
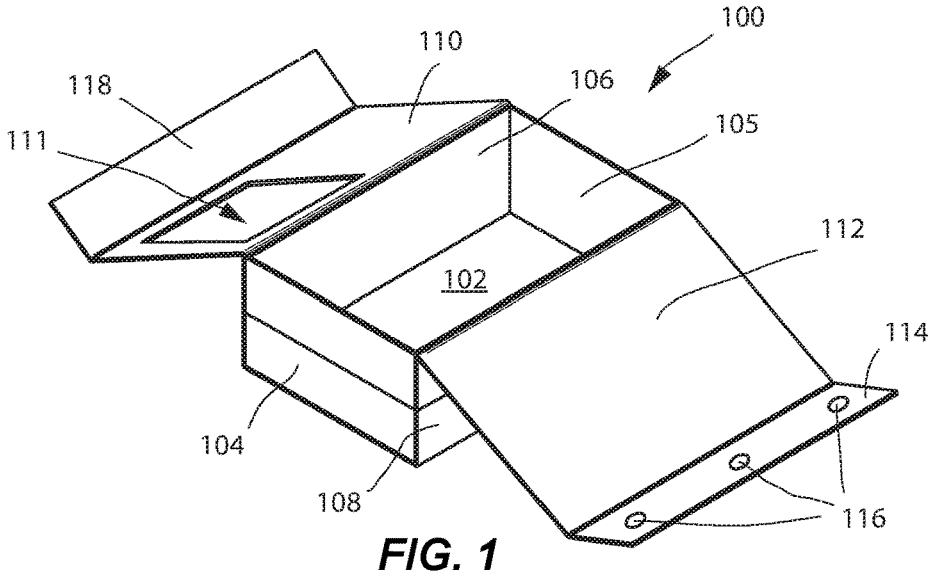
FIG. 1 is a perspective view of an embodiment of a packaging box for bed linens in an open configuration.

FIG. 1 illustrates a packaging box 100. The packaging box 100 includes a back panel 102, a top side panel 104, a bottom side panel 105, a first lateral side panel 106, and a second lateral side panel 108. The packaging box 100 further includes a first front panel 110, which in some embodiments may be attached at an edge thereof to an edge of one of the first and second lateral side panels 106, 108, and an exterior second front panel 112 attached at an edge thereof to an edge of the other of the first and second lateral side panels 106, 108. As a non-limiting example, the first front panel 110 may be attached to the first lateral side panel 106 and the second front panel 112 may be attached to the second lateral side panel 108, as shown in FIG. 1.

In additional embodiments, the first front panel 110 may be a panel that is separate from the other panels of the box 100 and simply disposed therein.

The first and second front panels 110, 112 may be configured to fold relative to the first and second lateral side panels 106, 108 to which they are respectively attached. One of the first and second front panels 110, 112 may be sized and configured so as to be an interior front panel enclosed within the packaging box 100 when the packaging box 100 is in a closed configuration, and the other of the first and second front panels 110, 112 may be sized and configured so as to be an exterior front panel exposed on the exterior of the packaging box 100 when the packaging box 100 is in the closed configuration. For example, in the embodiment shown in FIG. 1, the first front panel 110 is sized and configured so as to be an interior front panel enclosed within the packaging box 100 when the packaging box 100 is in a closed configuration, and the second front panel 112 is sized and configured so as to be an exterior front panel exposed on the exterior of the packaging box 100 when the packaging box 100 is in the closed configuration.

The exterior second front panel 112 further includes an exterior side panel 114 configured to lay adjacent the first lateral side panel 106 when the packaging box 100 is in the closed configuration, as described below with reference to FIGS. 5-7. The exterior side panel 114 includes at least one attachment device 116 securing the exterior side panel 114 to the adjacent first lateral side panel 106 when the packaging box 100 is in the closed configuration, which is shown in FIGS. 3-7.

The various panels of the packaging box 100 may be formed of and comprise a relatively rigid material, such as cardboard, a composite fiberboard material, or a polymeric (e.g., plastic) material. Other relatively rigid materials may also be employed.

Figure 2A:
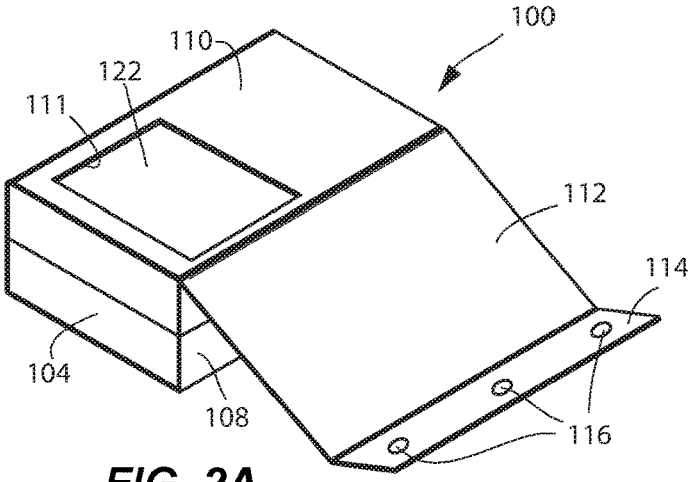
FIGS. 2A and 2B are perspective views of the packaging box of FIG. 1 with a bed linen inside the box and an interior front panel folded over the bed linen, with an exterior front panel in an open configuration.
Figure 2B:
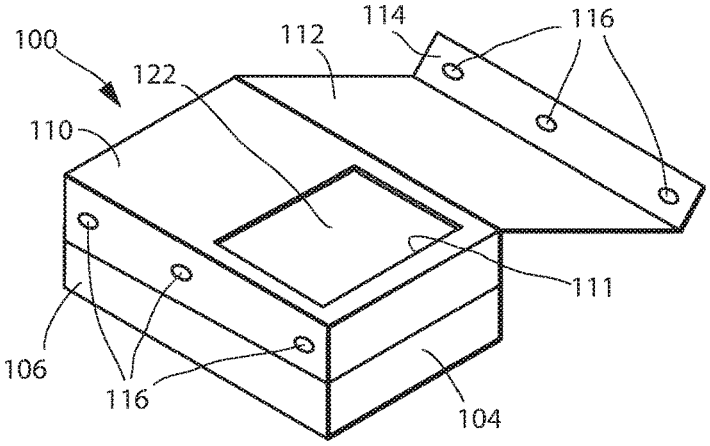
Figure 3:
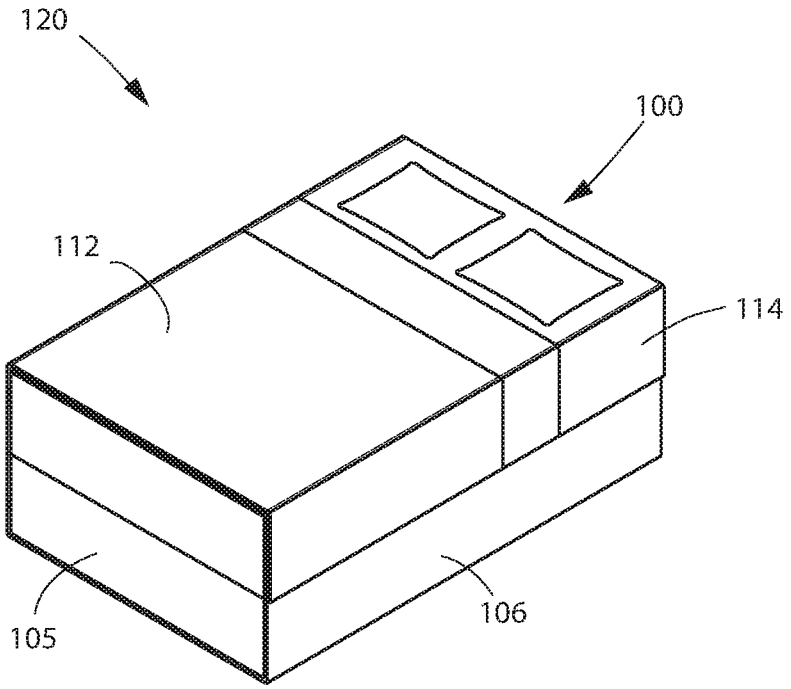
FIG. 3 is a perspective view of a packaged bed linen including a bed linen within the packaging box of FIGS. 1, 2A, and 2B, the packaging box being in a closed configuration.
Figure 4:
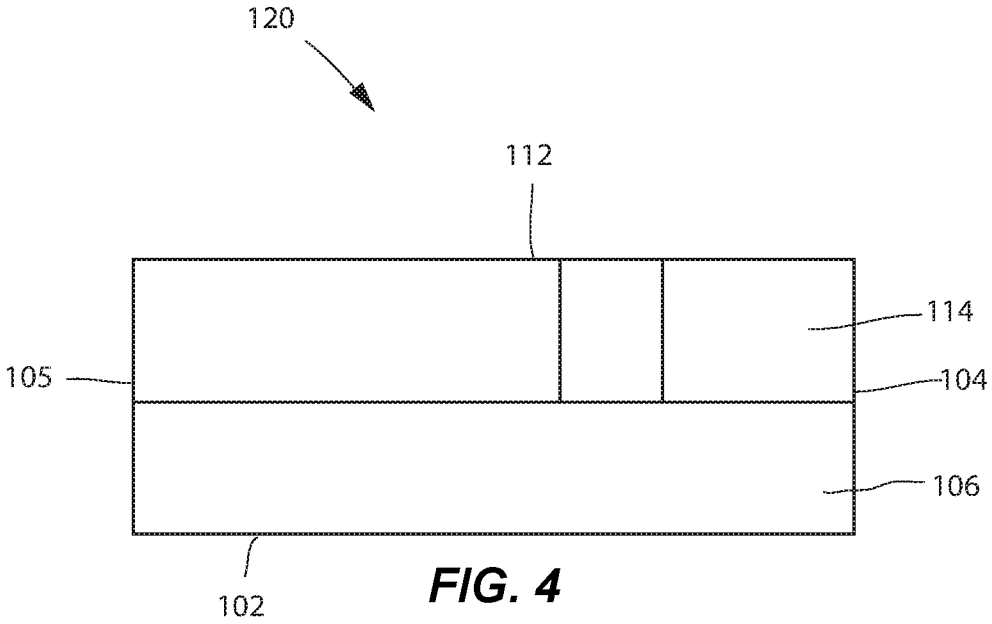
FIG. 4 is a right side view of the packaged bed linen of FIG. 3.

In some embodiments, a plurality of additional attachment devices 116' may be disposed on or in the first lateral side panel 106 as shown in FIG. 2B, and the attachment devices 116 and the additional attachment devices 116' may be complementary to one another and configured to bond or attach together when brought into proximity to one another.

As a non-limiting example, the attachment devices 116 and/or the additional attachment devices 116' may comprise permanent magnets. For example, the attachment devices 116 and the additional attachment devices 116' may comprise permanent magnets. As another example, the attachment devices 116 may comprise permanent magnets, and the additional attachment devices 116' may comprise a ferrous material or another material to which a magnet is attracted. In yet further embodiments, the attachment devices 116 may comprise a ferrous material or another material to which a magnet is attracted, and the additional attachment devices 116' may comprise permanent magnets. In such embodiments, magnetic forces between the attachment devices 116 and the additional attachment devices 116' may hold the exterior side panel 114 against the first lateral side panel 106 when the packaging box 100 is in the closed configuration of FIGS. 3-7.

In other embodiments, a hook-and-loop material (e.g., VELCRO®) may be used to secure the exterior side panel 114 against the first lateral side panel 106 when the box 100 is in the closed configuration. For example, the attachment devices 116 may comprise one component of hook-and-loop material (e.g., hook material), and the additional attachment devices 116' may comprise another component of the hook-and-loop material (e.g., loop material). The components of hook-and-loop material may be located and configured to be attached to one another when the packaging box 100 is in the closed configuration.

In yet further embodiments, snap fasteners may be used to secure the exterior side panel 114 against the first lateral side panel 106 when the box 100 is in the closed configuration. For example, each of the attachment devices 116 may comprise one component of a snap faster, and each of the additional attachment devices 116' may comprise another component of a snap fastener. The components of the snap fasteners may be located and configured to be attached to one another when the packaging box 100 is in the closed configuration.

Any other type of fastener or fastening material may be employed as the attachment devices 116 and/or the additional attachment devices 116'. Furthermore, although three (3) attachment devices 116 and three (3) additional attachment devices 116' are illustrated in the figures, any number (e.g., 0, 1, 2, 4, etc.) of attachment devices 116 and/or additional attachment devices 116' may be employed in other embodiments of the present disclosure.

The exterior second front panel 112, exterior side panel 114, and the attachment devices 116, 116' help in maintaining a clean look and feel and hold the exterior second front panel 112 secure so the package 100 is not damaged in transit, but also allow the customer to easily access a sample area of the package 100 where they can experience a bed linen product contained therein, which is an important experience when buying bed linens.

In some embodiments, the interior first front panel 110 may include an interior side panel 118, which may be folded relative to the interior first front panel 110 and disposed within the packaging box 100 adjacent the second lateral side panel 108. The interior side panel 118 may help to keep the bed linen 122 securely in place within the packaging box 100 under the interior first front panel 110.

As shown in FIGS. 1, 2A, and 2B, the interior first front panel 110 may include an aperture 111 extending therethrough so as to enable a person to touch a fabric of the bed linen 122 through the interior first front panel 110. This allows a potential customer to feel the fabric of the bed linen 122 in a store prior to purchasing the packaged bed linen 120, and without completely opening or damaging the packaging box 100. Optionally, comparative samples of fabric of other competitive bed linens may also be included so as to allow a potential customer to compare the fabric of the bed linen 122 to the fabric of other competitive and commercially available bed linens.

In other embodiments, the interior first front panel 110 may not include such an aperture 111. In such embodiments, a sample of fabric that is identical to a fabric of the bed linen 122 may be secured to an exterior surface of the interior first front panel 110, and/or to an interior surface of the exterior second front panel 112 so as to allow a potential purchaser to open the exterior second front panel 112 and feel the fabric sample without completely opening or damaging the packaging box 100. The fabric sample may take the form of a sample swatch or swatches of fabric that are securely adhered or fastened to the relatively rigid material of the interior first front panel 110 and/or exterior second front panel 112.

The bed linen 122 may comprise one or more of a flat bed sheet, a fitted bed sheet, a pillowcase, or a mattress protector. In some non-limiting embodiments, the bed linen 122 may be a set of bed sheets consisting of a flat bed sheet, a fitted bed sheet, and one or two pillowcases. In other non-limiting embodiments, the bed linen 122 may be a single mattress protector.

A packaged bed linen 120 may be formed by placing a bed linen 122 within the packaging box 100, and folding the interior first front panel 110 over the bed linen 122 to form the structure shown in FIGS. 2A and 2B, and then folding the exterior second front panel 112 over the interior first front panel 110 to form the packaged bed linen 120 shown in FIGS. 3-7. More particularly, a packaging box 100 may be formed as described above. After forming the packaging box 100, at least one bed linen 122 may be disposed in a space defined by the back panel 102, the top side panel 104, the bottom side panel 105, the first lateral side panel 106, and the second lateral side panel 108 of the packaging box 100. The interior first front panel 110 then may be folded relative to the first lateral side panel 106 to which it is attached, such that the interior first front panel 110 at least partially covers the bed linen 122 within the packaging box 100. The exterior second front panel 112 then may be folded relative to the second lateral side panel 108 to which it is attached, such that the exterior second front panel 112 is disposed adjacent the interior front panel 110. The exterior side panel 114 may be folded relative to the exterior front panel 112, and the exterior side panel 114 may be secured to the adjacent first lateral side panel 106.

The double-fold front provided by the interior front panel 110 and the exterior front panel 112 protects the bed linen 122 and/or sample fabric material, but also gives the manufacturer more space for branding, marketing, and product information, and also enables a sensory experience of the product at the same time. The exterior second front panel 112 includes the exterior side panel 114, which extends partway down the lateral side panel 106 to close the packaging box 100. When the exterior second front panel 112 is opened, the interior first front panel 110 is revealed underneath, which exposes the additional space for branding, marketing, and product information and allows a potential purchaser to feel the bed linen 122 or a sample of bed linen fabric.

Embodiments of the disclosure are susceptible to various modifications and alternative forms. Specific embodiments have been shown in the drawings and described in detail herein to provide illustrative examples of embodiments of the disclosure. However, the disclosure is not limited to the particular forms disclosed herein. Rather, embodiments of the disclosure may include all modifications, equivalents, and alternatives falling within the scope of the disclosure as broadly defined herein. Furthermore, elements and features described herein in relation to some embodiments may be implemented in other embodiments of the disclosure, and may be combined with elements and features described herein in relation to other embodiments to provide yet further embodiments of the disclosure.

What is claimed is:

1. A method of packaging a linen, comprising:

forming a packaging box including:

a back panel;

a top side panel;

a bottom side panel;

a first lateral side panel;

a second lateral side panel;

a first front panel attached at an edge thereof to an edge of the first lateral side panel; and a second front panel attached at an edge thereof to an edge of the second lateral side panel; and wherein the first front panel is sized and configured to be an interior front panel enclosed within the packaging box when the packaging box is in a closed configuration, the second front panel sized and configured to be an exterior front panel when the packaging box is in the closed configuration, the exterior front panel comprising an exterior side panel configured to lay adjacent the first lateral side panel when the packaging box is in the closed configuration, the exterior side panel extending only partially down a side of the first lateral side panel and including at least one attachment device securing the exterior side panel to the first lateral side panel when the packaging box is in the closed configuration;

disposing at least one linen in the packaging box;

positioning the interior front panel so as to at least partially cover the at least one linen within the packaging box;

folding the exterior front panel such that the exterior front panel is disposed adjacent the interior front panel;

folding the exterior side panel relative to the exterior front panel, and securing the exterior side panel to the first lateral side panel; and securing a sample of fabric identical to a fabric of the at least one linen to an exterior surface of the interior front panel such that the sample of fabric is disposed completely between the interior front panel and the exterior front panel when the packaging box is in the closed configuration.

2. The method of claim 1, wherein the adjacent one of the first and second lateral side panels comprises at least one additional attachment device, and wherein securing the exterior side panel to the adjacent one of the first and second lateral side panels comprises coupling or attracting the at least one attachment device of the exterior side panel to the at least one additional attachment device of the adjacent one of the first and second lateral side panels.

3. The method of claim 2, further comprising selecting at least one of the at least one attachment device or the at least one additional attachment device to comprise a permanent magnet.

4. The method of claim 2, further comprising selecting the at least one attachment device to comprise one component of a hook-and-loop material and selecting the at least one additional attachment device to comprise another component of the hook-and-loop material.

5. The method of claim 2, further comprising selecting the at least one attachment device to comprise one component of a snap fastener and selecting the at least one additional attachment device to comprise another component of the snap fastener.

6. The method of claim 1, wherein forming the packaging box further comprises forming the interior front panel to comprise an interior side panel configured to lay adjacent an interior side of one of the first and second lateral side panels when the packaging box is in the closed configuration.

7. The method of claim 1, wherein disposing the at least one linen in the space comprises disposing at least one of a flat bed sheet, a fitted bed sheet, a pillowcase, or a mattress protector in the space.

8. A method of packaging a linen, comprising:

forming a packaging box including:

a rectangular container;

a first front panel attached to an upper edge of a first lateral side of the rectangular container; and a second front panel attached to an upper edge of a second opposite lateral side of the rectangular container and comprising an exterior side panel configured to lay adjacent to the first lateral side of the rectangular container when the packaging box is in a closed configuration, the exterior side panel extending only partially down a height of the first lateral side of the rectangular container when the packaging box is in the closed configuration and including at least one attachment device securing the exterior side panel to the first lateral side of the rectangular container;

disposing at least one linen in a space defined by the packaging box;

folding the first front panel over the at least one linen, the first front panel being sized and configured to be an interior front panel behind the second front panel when the packaging box is in the closed configuration;

folding the second front panel over the first front panel thereby exposing the second front panel on the exterior of the packaging box when the packaging box is in the closed configuration; and securing a sample of fabric identical to a fabric of the at least one linen to an exterior surface of the first front panel such that the sample of fabric is disposed completely between the first front panel and the second front panel when the packaging box is in the closed configuration.

9. The method of claim 8, further comprising securing at least one additional attachment device to the first lateral side of the rectangular container for coupling to the at least one attachment device of the exterior side panel when the packaging box is in the closed configuration.

10. The method of claim 9, wherein securing the exterior side panel to the first lateral side of the rectangular container comprises coupling or attracting the at least one attachment device of the exterior side panel to the at least one additional attachment device on the first lateral side of the rectangular container.

11. The method of claim 10, further comprising selecting at least one of the at least one attachment device or the at least one additional attachment device to comprise a permanent magnet.

12. The method of claim 10, further comprising:

selecting the at least one attachment device to comprise one component of a hook-and-loop material; and selecting the at least one additional attachment device to comprise another component of the hook-and-loop material.

13. The method of claim 10, further comprising:

selecting the at least one attachment device to comprise one component of a snap fastener; and selecting the at least one additional attachment device to comprise another component of the snap fastener.

14. A method of packaging a bed linen, comprising:

selecting a relatively rigid material from at least one of cardboard, a composite fiberboard material, or a polymeric material such as plastic;

forming a packaging box from the relatively rigid material including:

a back panel;

a top side panel;

a bottom side panel;

a first lateral side panel;

a second lateral side panel;

a first front panel attached at an edge thereof to an edge of the first lateral side panel; and a second front panel attached at an edge thereof to an edge of the second lateral side panel; and wherein the first front panel is sized and configured to be an interior front panel enclosed within the packaging box when the packaging box is in a closed configuration, the second front panel sized and configured to be an exterior front panel of the packaging box when the packaging box is in the closed configuration, the exterior front panel comprising an exterior side panel that lays adjacent the first lateral side panel when the packaging box is in the closed configuration, the exterior side panel including at least one attachment device securing the exterior side panel to the first lateral side panel when the packaging box is in the closed configuration;

disposing at least one bed linen in the packaging box;

positioning the interior front panel to at least partially cover the at least one bed linen within the packaging box;

fixing at least one sample of fabric identical to a fabric of the at least one bed linen to an exterior surface of the interior front panel;

folding the exterior front panel over the interior front panel and an entirety of the at least one sample of fabric, enclosing the of fabric, enclosing the at least one sample of fabric completely between die interior front panel and the exterior front panel; and folding the exterior side panel relative to the exterior front panel, and securing the exterior side panel to the first lateral side panel.

15. The method of claim 14, wherein the adjacent one of the first and second lateral side panels comprises at least one additional attachment device, and wherein securing the exterior side panel to the adjacent one of the first and second lateral side panels comprises coupling or attracting the at least one attachment device of the exterior side panel to the at least one additional attachment device of the adjacent one of the first and second lateral side panels.

16. The method of claim 14, wherein disposing the at least one bed linen in the space comprises disposing at least one of a flat bed sheet, a fitted bed sheet, a pillowcase, or a mattress protector in the space.

* * * * *